US007191606B1

(12) United States Patent
Dwyer

(10) Patent No.: US 7,191,606 B1
(45) Date of Patent: Mar. 20, 2007

(54) DRAIN TRAP ALARM

(76) Inventor: Kenneth W. Dwyer, 21 Judy Rd., Scituate, MA (US) 02066

( * ) Notice: Subject to any disclaimer, the term of this patent is extended or adjusted under 35 U.S.C. 154(b) by 0 days.

(21) Appl. No.: 11/118,307

(22) Filed: Apr. 29, 2005

(51) Int. Cl.
*F25D 21/00* (2006.01)
*F25D 21/14* (2006.01)

(52) U.S. Cl. ..... 62/150; 62/272; 62/285; 62/291

(58) Field of Classification Search ..... 62/150, 62/272, 285, 291
See application file for complete search history.

(56) References Cited

U.S. PATENT DOCUMENTS 4,218,786 A * 8/1980 Taglarino ..... 4/679
4,497,337 A * 2/1985 Mosbrucker et al. ..... 137/247.25
4,918,935 A 4/1990 Trent
5,522,229 A * 6/1996 Stuchlik et al. ..... 62/127
6,442,955 B1 * 9/2002 Oakner et al. ..... 62/150
6,487,867 B1 * 12/2002 Herren ..... 62/150
6,584,995 B2 7/2003 Kimbrough
6,666,966 B1 * 12/2003 Schluttig ..... 210/163
2002/0124582 A1 * 9/2002 Oakner et al. ..... 62/150
2005/0138939 A1 * 6/2005 Spanger ..... 62/150
2005/0166613 A1 * 8/2005 Oakner et al. ..... 62/150
2005/0166615 A1 * 8/2005 Carr et al. ..... 62/171

* cited by examiner

*Primary Examiner*—Melvin Jones
*Assistant Examiner*—B. Clayton McCraw
(74) *Attorney, Agent, or Firm*—Gary E. Lambert; Daniel N. Smith; Lambert and Associates

(57) ABSTRACT

A Drain Trap Alarm for Heating Ventilation Air Conditioning condensate drain system includes a upstream port coupled to the cooling coil drain tray followed with a U-type trap and a downstream port coupled to the external atmosphere. The invention is provided with a liquid level sensor and continuously monitors the liquid level of drain trap. The signal from the liquid level sensor in communication with the microprocessor will notify operating personnel that the condensate drain is malfunctioning and activate the automatic prime valve to restore the dry drain trap condition to normal operation. The microprocessor provides operational test enabling the HVAC operating personnel to quickly test Drain Trap Alarm.

18 Claims, 8 Drawing Sheets

Figure 3:
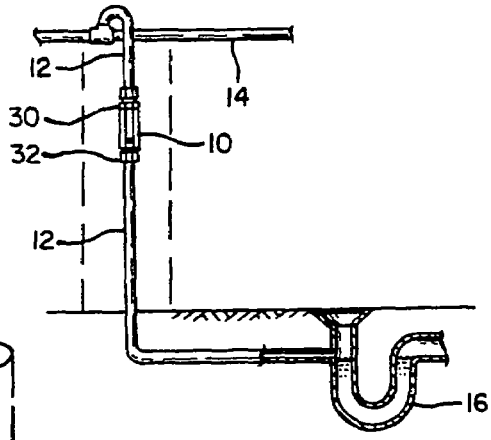

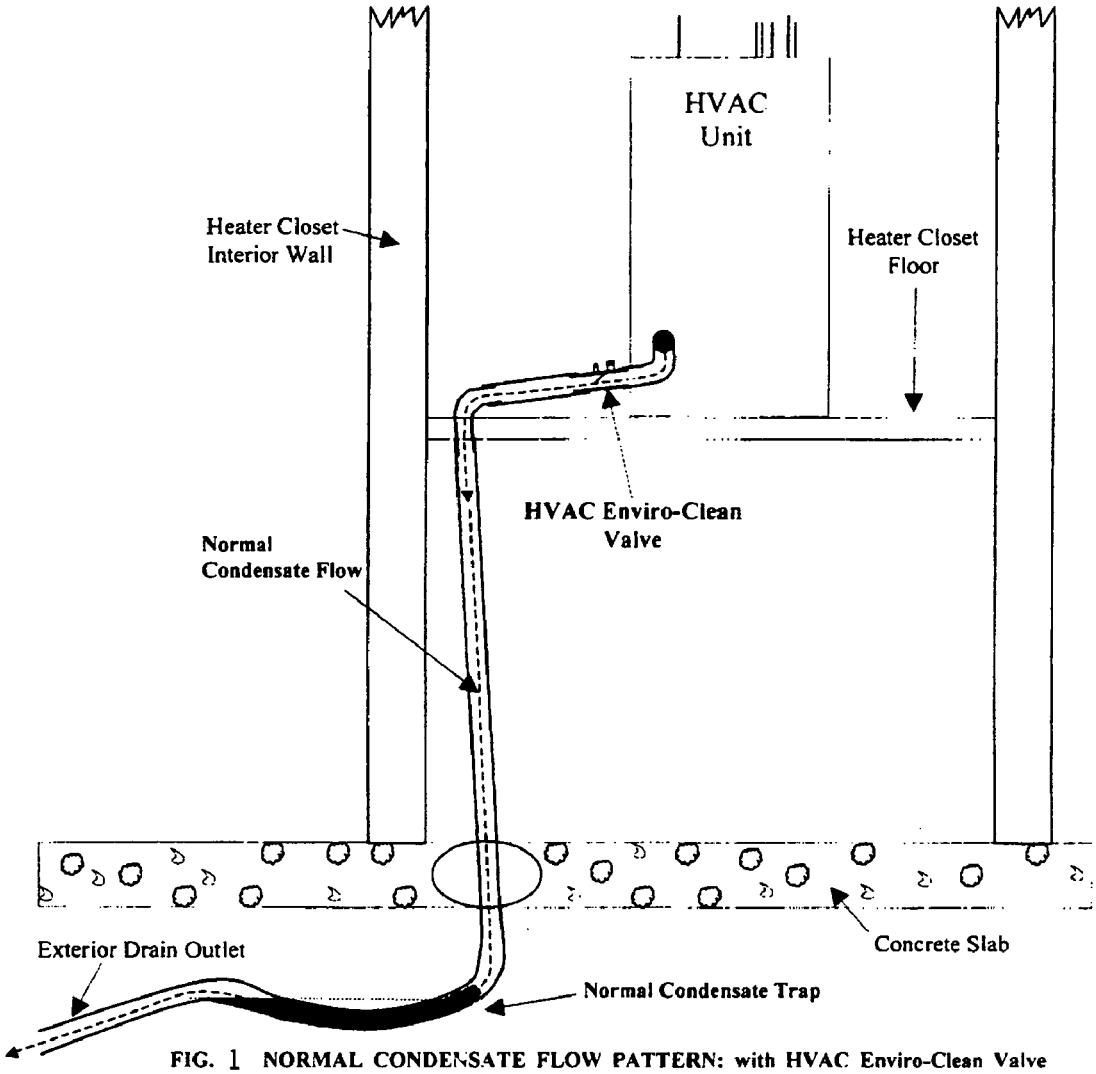
FIG. 1 NORMAL CONDENSATE FLOW PATTERN: with HVAC Enviro-Clean Valve installed.
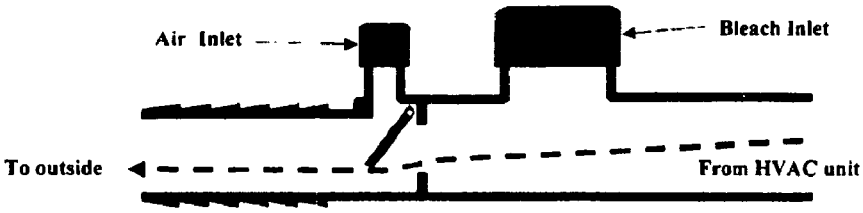
FIG. 2 NORMAL CONDENSATE FLOW: through Enviro-Clean Valve

DRAIN TRAP ALARM

CROSS-REFERENCE TO RELATED APPLICATIONS

This application claims the benefit of provisional patent application Ser. No. 10/837,492

FEDERALLY SPONSORED RESEARCH

Not Applicable

SEQUENCE LISTING OR PROGRAM

Not Applicable

BACKGROUND OF THE INVENTION

1. Field of Invention

This invention generally relates to a drain trap with an alarm sensor, specifically to a drain tray of the type used in Heating, Ventilation and Air Conditioning system.

2. Prior Art

The Heating Ventilation Air Conditioning (HVAC) air handling units are provided with drain traps that provide a water seal-forming wall in condensate drain and prevent odor sanitary sewer gases, unfiltered air from entering the supply air and impacting indoor air quality. During the summer the air handling unit provides cooling, which in return develops condensation and is the primary element for a drain trap successful operation. The condensation is removed by the condensate drain which include a drain trap. During the winter months, when the air conditioning system is operating in the heating mode, condensate drain traps frequently become dry and do not provide a seal against the ingestion of polluted air or gases from sanitary sewers or other disposal places. Modem HVAC systems do not provide for detecting this critical malfunction. Current HVAC drain trap have no ability to detect if a drain trap is dry allowing the ingestion of polluted air from the sewer into the air conditioning system.

There are a number of patents which have been directed to HVAC related drain traps. None solve this serious problem. U.S. Pat. No. 6,584,995 discloses a device which allows a user to treat microbial and bacteria growth inside a HVAC condensate drain line or clear a clogged line without cutting into a drain line. Our valve is an in-line condensate drain line valve that can be installed easily, quickly and economically either during new construction or onto existing HVAC systems. The HVAC user can add household bleach to the condensate line, which inhibits microbial and bacteria growth without cutting into or disassembling the drain line. The design of our valve allows the user to perform safe routine maintenance to the HVAC drainage system without having to resort to expensive and repetitive service call repairs over the lifetime of the HVAC system. The valve is further designed to prevent undesirable reverse airflows into the HVAC system and home or building caused by a dry water trap in the condensate drain. The prevention of reverse airflows and reduction of microbial and bacteria growth will have a positive impact of indoor air quality. The U.S. Pat. No. 6,584,995 The HVAC Enviro-clean Valve as shown in FIG. 1, FIG. 2 offsets a malfunctioning drain trap with a check-valve located in the condensate drain line. The Drain Trap Alarm monitors drain trap operation 24 hours a day 7 days a week and alerts HVAC operating personnel if critical device is malfunctioning and execute commands to correct malfunction and sends data reporting when system is return to normal.

Figure 4:
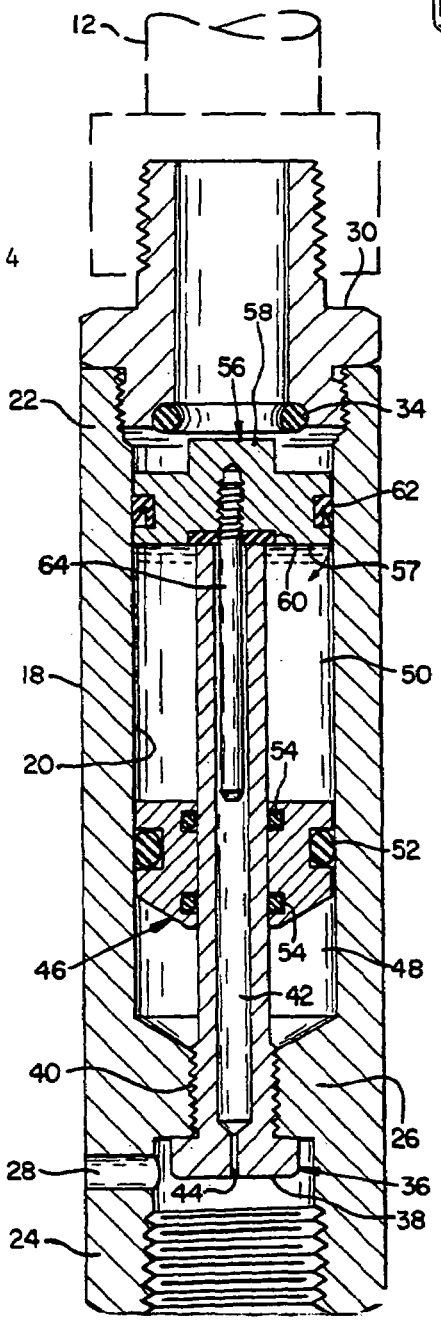

U.S. Pat. No. 4,497,337 discloses a device which automatically charges water into a sewer line from a water line containing water under variable pressure comprises a case having a longitudinal bore and means for connecting the case in series flow in the water line. A hollow shaft is mounted in the case and extends from the downstream portion a predetermined distance toward the upstream portion thereof. A piston slidably mounted on the shaft divides the bore of the case into an air chamber downstream of the piston and a water chamber upstream. A floating seal is mounted within the water chamber upstream of the piston and hollow shaft. The seal is advanced and retracted with fluctuations if water pressure in the water line. In its retracted position it charges the water chamber with water and compresses the air in the chamber. In its advanced position, it discharges the water content of the water chamber into the trap, thereby maintaining the water level thereof. The U.S. Pat. No. 4,497,337 provide continuous charging of water as shown in FIG. 3, FIG. 4, when fluctuations in pressures are sensed by floor primer valve. The Drain Trap Alarm provides continuous monitoring of condensate drain trap operation, malfunctions are immediately reported to HVAC operating personnel. Monitoring a condensate drain system is critical in preventing sanitary sewer gases from entering air conditioning system Condensate drain malfunctions result in occupants ingesting polluted air from HVAC system average malfunction last 3 to 6 months.

U.S. Pat. No. 4,918,935 discloses and apparatus to remove liquid from a chamber (B) of sub-atmospheric pressure in an air conditioning system wherein a liquid removal conduit (28) is connected to communicate with a chamber of sub-atmospheric pressure and with a condensate disposal place. Air at a pressure above ambient pressure, is delivered through an air line (30) into the flow control (10) between the chamber of sub-atmospheric pressure and the condensate disposal place. The flow rate of air into the liquid removal conduit (10) is controlled to permit flow of liquid through the conduit toward the condensate disposal place while preventing flow of gas through the conduit toward the chamber (A) of sub-atmospheric pressure. The flow rate of gas is controlled by a valve (48) in an air line (30) connected to the conduit (28) and by forming a tortuous path 50(*a*), 50(*b*), 50(*c*), and 50(*d*) in the flow control (10) to induce a loss in gas pressure without restricting flow of liquid.

Figure 11:
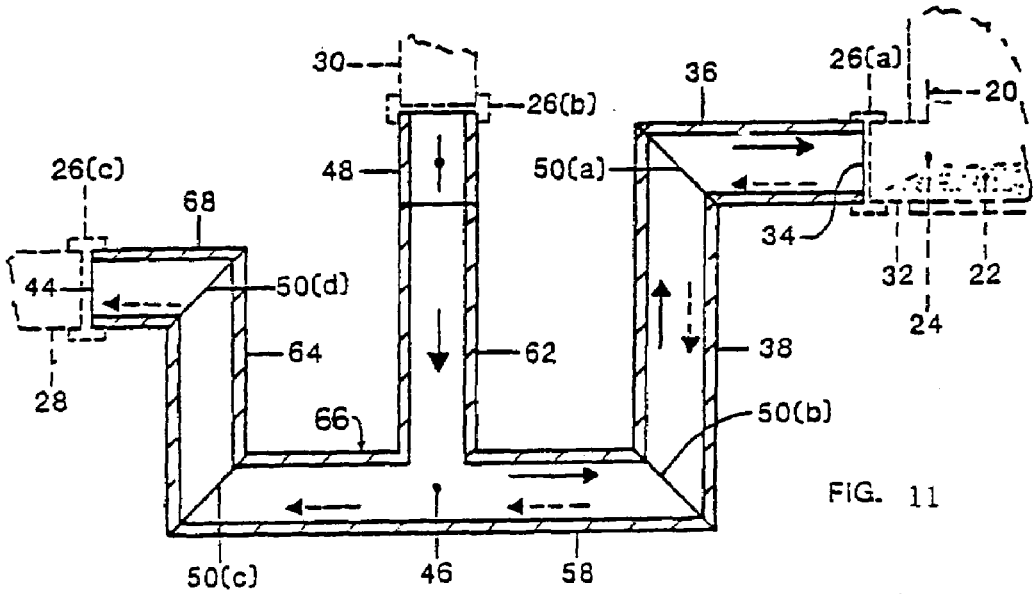

U.S. Pat. No. 4,918,935 discloses a fluidic flow device that is supplied with air from the discharge of the HVAC fan This air is then directed to the condensate conduit which in return seals the sanitary sewer gases from entering the fan. When the fan is shut off during unoccupied mode the fluidic flow control seal vanishes allowing the sanitary gases to freely enter the fan chamber. Negative air pressure in a fan plenum when that fan is off is quite common i.e. building HVAC fans are off but toilet exhaust fans are all on and drawing air from all convenient sources. The fifth embodiment FIG. 11 illustrates the fluidic flow control including a U-trap piping design. The fluidic flow control seal vanishes when fan is off and the U-trap design provide a positive seal from sewer gases when condensate is available, condensate not available in winter. The Drain Trap Alarm provide continuous monitoring of drain trap operation, immediately notifying operating personnel of a drain trap malfunction. A automatic prime valve is activated during alarm establishing A seal and preventing ingestion of polluted air from the sanitary sewer into the air conditioning system.

BACKGROUND OF THE INVENTION—OBJECTS AND ADVANTAGES

In its basic concept, this invention provides a drain trap monitoring system for condensate drains lines, several objects and advantages are:

(a) To provide a microprocessor design to process drain trap operation.

(b) To provide a liquid level sensor at the drain trap that immediately sensors a malfunctioning drain trap 24 hours a day seven days a week.

(c) To provide a control panel alarm indicator.

(d) To provide a automatic prime valve that will be triggered by the liquid level sensor an correct dry drain trap alarm condition to a normal operating condition.

Further objects and advantages are to provide a operational test switch enabling the HVAC personnel to test drain trap alarm

SUMMARY OF INVENTION

In accordance with the present invention, an HVAC Drain Trap Alarm comprises of a liquid level sensor situated within the drain trap an communicating to a microprocessor and activating an alarm condition when the fluid level within drain trap drops below a predetermined level, and alarm means liquid level sensor has sensed the fluid within drain trap is below a predetermined level.

In a further embodiment, the present invention is an HVAC Drain Trap Alarm comprising a liquid level sensor communicating to a microprocessor and activating a automatic prime valve solenoid and providing fluid to drain trap until alarm condition is return to normal operation.

In yet a further embodiment, the present invention an HVAC Drain Trap Alarm comprising a liquid level sensor situated within a drain trap an communicating to a microprocessor and signaling an remote alarm.

In yet a further embodiment, the present invention an HVAC Drain Trap Alarm comprising a liquid level sensor communicating to a microprocessor and signaling an control panel alarm.

DETAILED DESCRIPTION OF THE FIGURES

FIG. 1 U.S. Pat. No. 6,584,995—Condensate drain trap and Enviro-Clean Valve

FIG. 2 U.S. Pat. No. 6,584,995—Envir-Clean Valve

Figure 5:
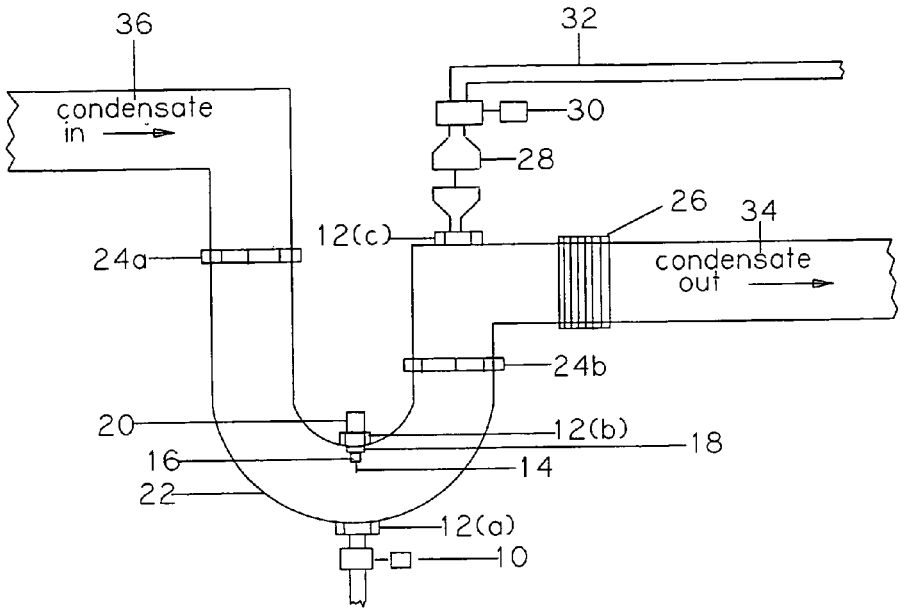
Figure 6:
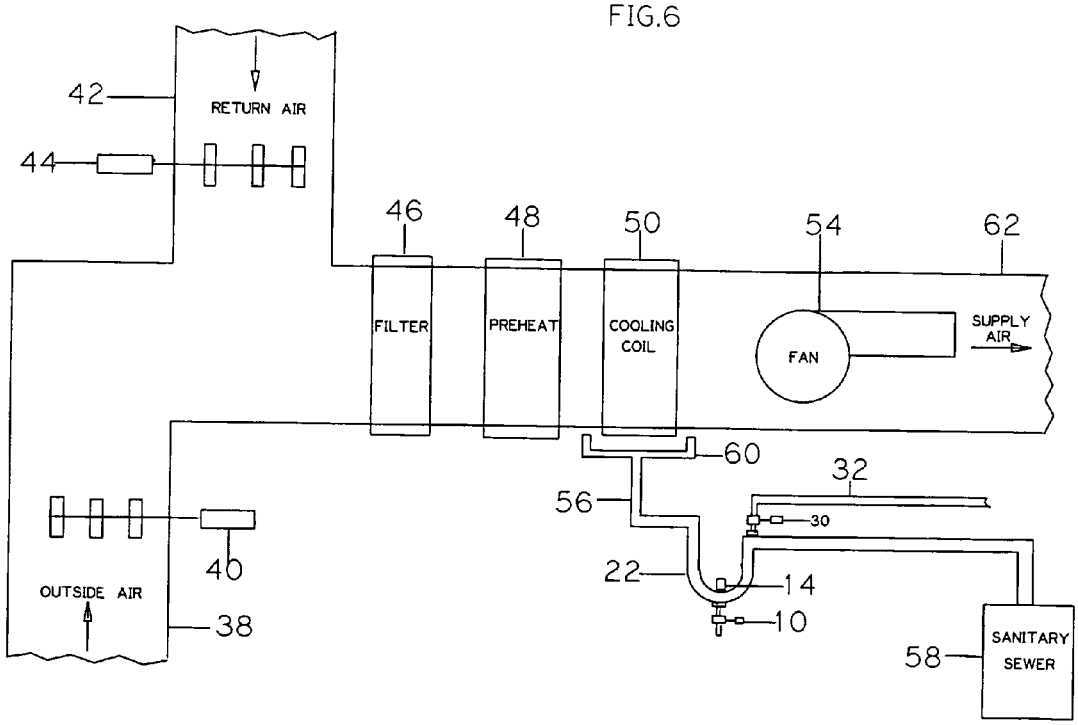
Figure 7:
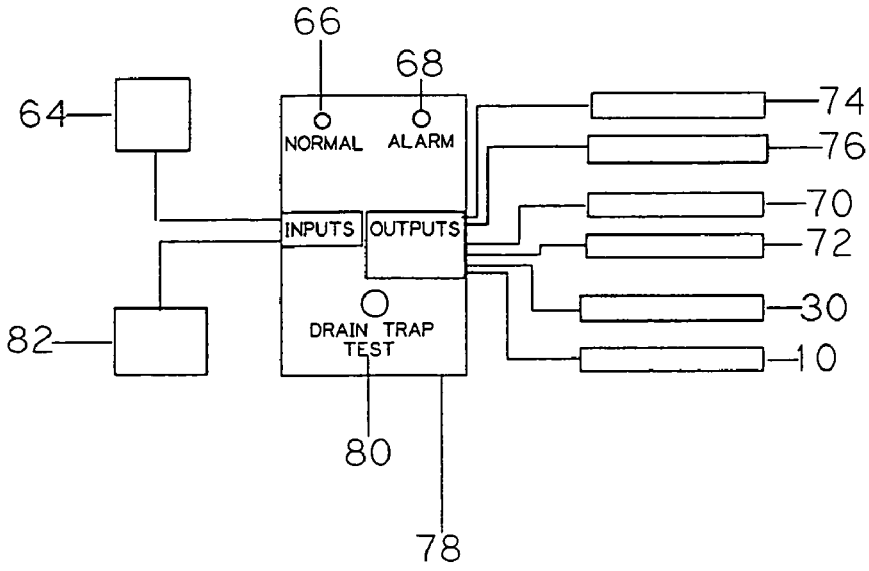
Figure 8:
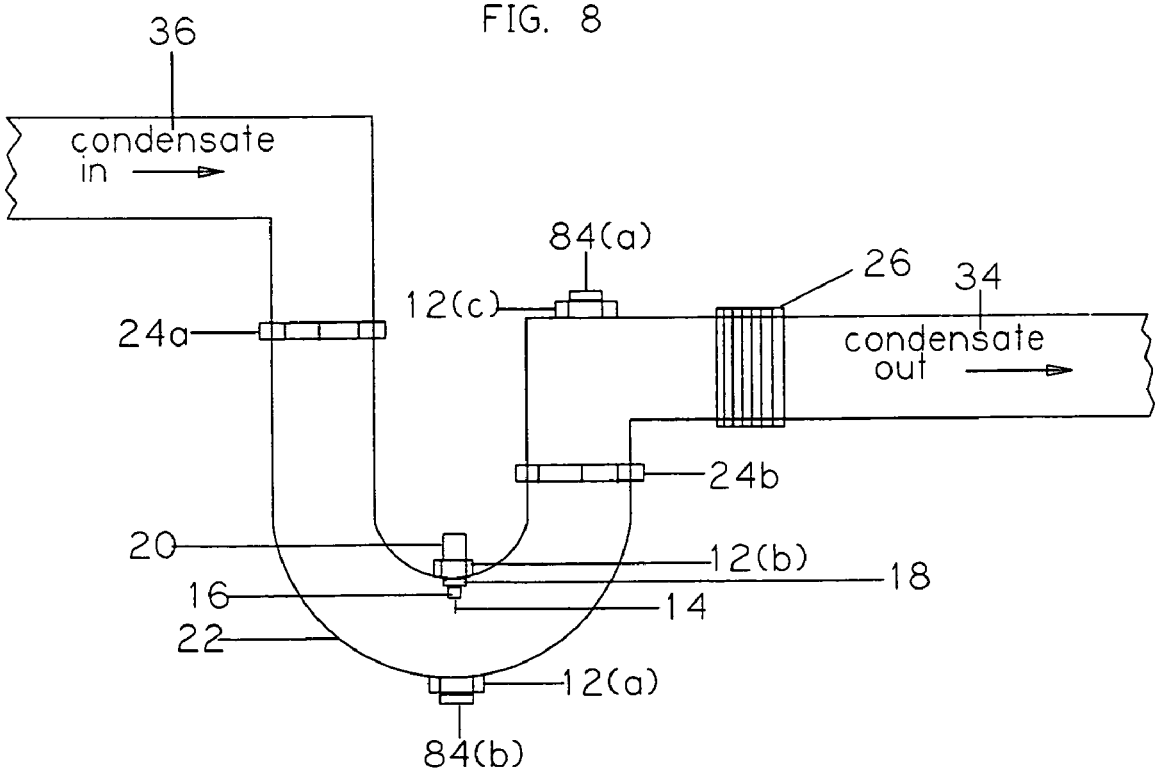
Figure 9:
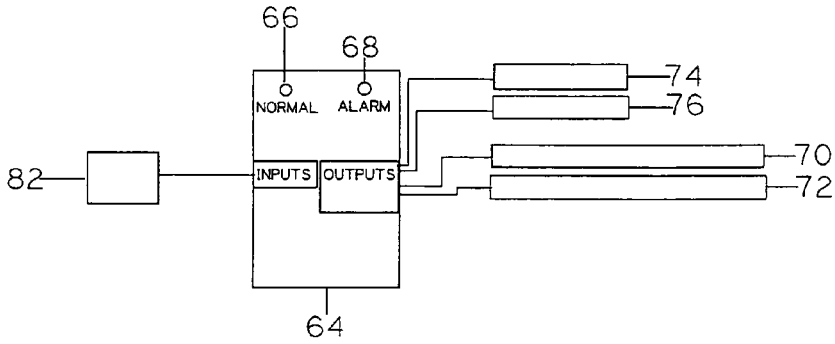
Figure 10:
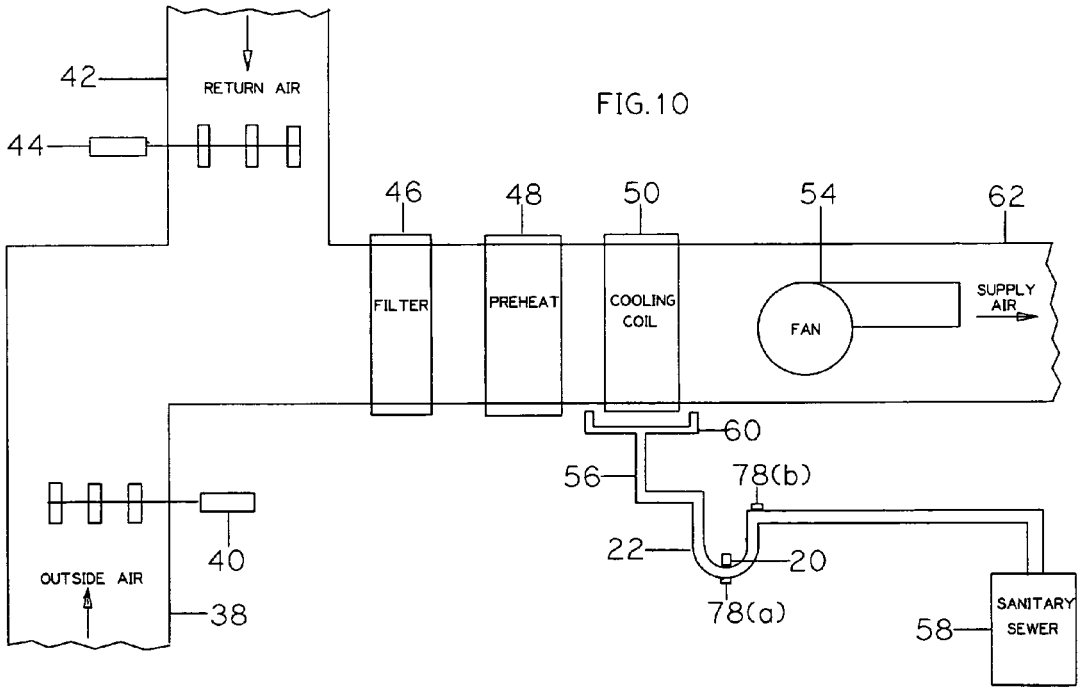
Figure 12:
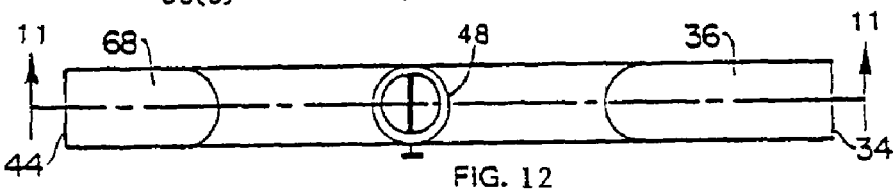
Figure 13:
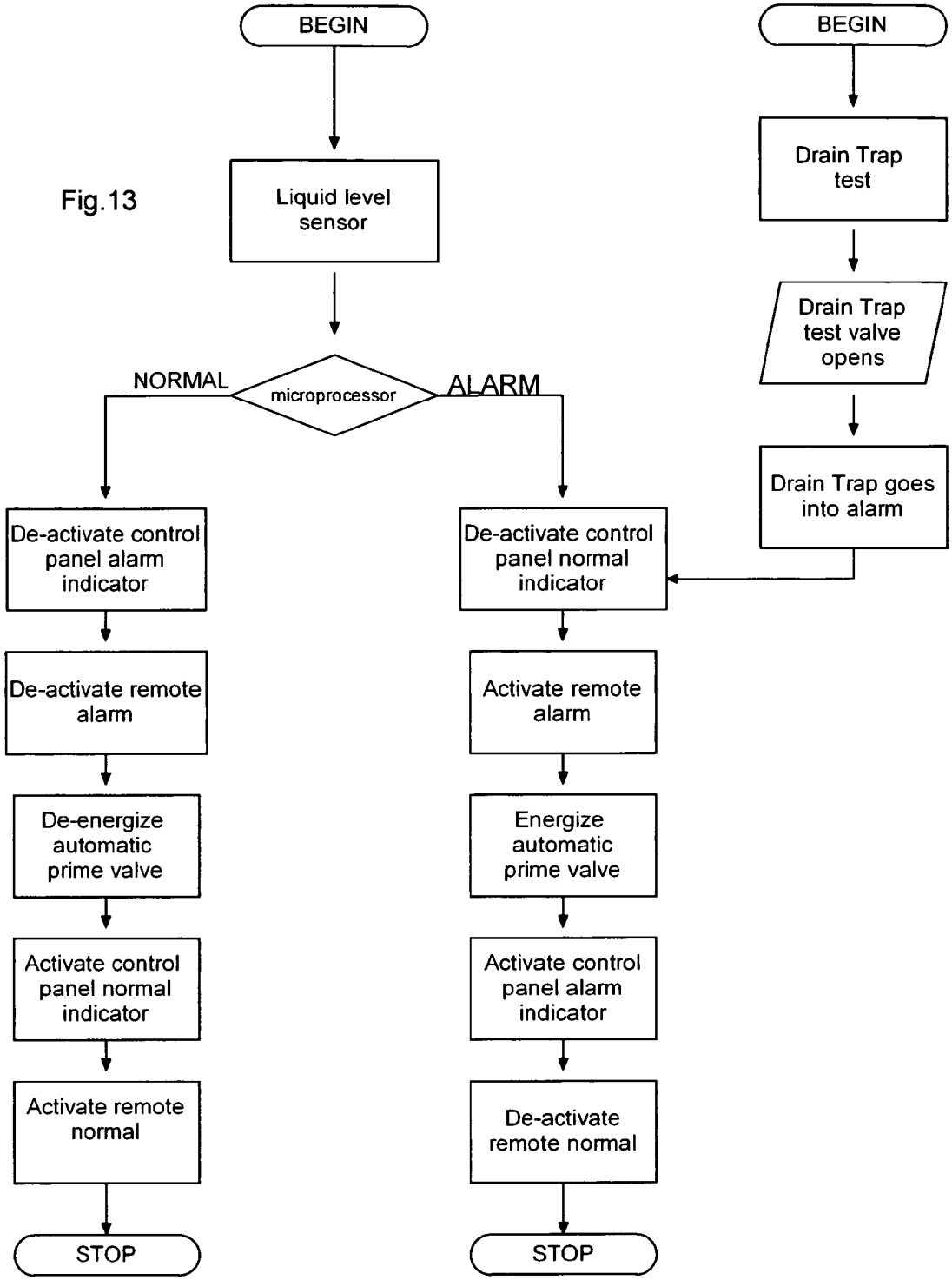
Figure 14:
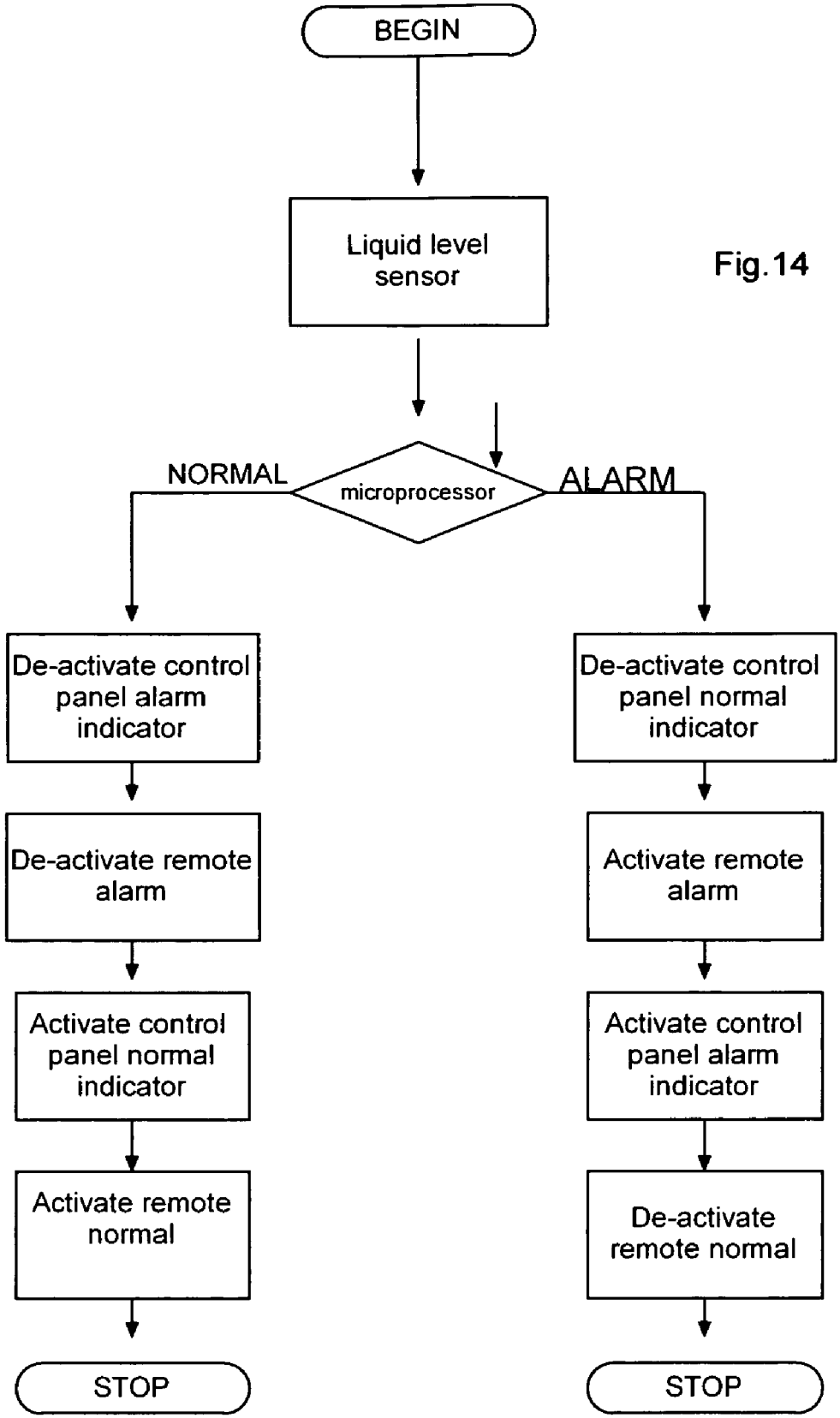

FIG. 3 U.S. Pat. No. 4,497,337—Is a schematic diagram illustrating the manner of the presently described sewer line trap valve FIG. 4 U.S. Pat. No. 4,497,337—is a longitudinal section of the valve in its charged position FIG. 5 Is a diagram of Drain Trap Alarm of present invention FIG. 6 Is a diagram of operation of present invention preferred embodiment FIG. 7 Is a diagram of Microprocessor of present invention preferred embodiment FIG. 8 Is a diagram of Drain Trap Alarm of present invention alternative embodiment FIG. 9 Is a diagram of Microprocessor of present invention alternative embodiment FIG. 10 Is a diagram of operation of present invention alternative embodiment FIG. 11 U.S. Pat. No. 4,918,935 cross sectional of the Fluidic Flow Control fifth embodiment FIG. 12 U.S. Pat. No. 4,918,935 is a top plan view of the fluidic flow control fifth embodiment FIG. 13 Is a Flowchart of present invention preferred embodiment FIG. 14 Is a Flowchart of present invention alternative embodiment

DRAWING REFERENCE NUMERAL

FIG. 5
10 Drain trap test valve
12(*a*) Internal threaded port (drain trap test valve)
12(*b*) Internal threaded port (liquid level sensor)
12(*c*) Internal threaded port (automatic prime valve)
14 Stainless steel sensor probe
16 Fused insulator
18 Sensor body
20 Liquid level sensor
22 Drain trap
24(*a*) Slip joint nut and seal
24(*b*) Slip joint nut and seal
26 Ground joint elbow with female thread
28 Fixed air gap fitting
30 Automatic prime valve
32 Domestic water conduit
34 Condensate out conduit
36 Condensate in conduit FIG. 6
10 Drain trap test valve
20 Liquid level sensor
22 Drain trap
30 Automatic prime valve
32 Domestic water conduit
38 Outside air plenum
40 Outside air damper
42 Return air plenum
44 Return air damper
46 Intake filter
48 Preheat coil
50 Cooling coil
54 Supply air fan
56 Condensate drain
58 Sanitary sewer
60 Condensate drain tray
62 Supply air plenum FIG. 7
10 Drain trap test valve
30 Automatic prime valve
64 Drain trap test input
66 Control panel normal indicator
72 Microprocessor output-normal signal
68 Control panel alarm indicator
70 Microprocessor output—alarm signal
72 Remote alarm
76 Remote normal
80 Drain trap test button
78 Microprocessor
82 Liquid level sensor input FIG. 8
84(*a*) ¾ inch male threaded plug (manual prime port)
84(*b*) ¾ inch male threaded plug (routine service port)
12(*a*) Internal threaded port (drain trap test valve)
12(*b*) Internal threaded port (liquid level sensor)
12(*c*) Internal threaded port
20 Liquid level sensor
22 Drain trap
24(*a*) Slip joint nut
24(*b*) Slip joint nut
26 Ground joint elbow with female thread
34 Condensate out conduit
36 Condensate in conduit FIG. 9
82 Liquid level sensor input
66 Control panel normal indicator
72 Microprocessor output—normal signal
68 Control panel alarm indicator
70 Microprocessor output—alarm signal
74 Remote alarm
76 Remote normal
78 Microprocessor FIG. 10
20 Liquid level sensor
22 Drain trap
38 Outside air plenum
40 Outside air damper
42 Return air plenum
44 Return air damper
46 Intake filter
48 Preheat coil
50 Cooling coil
54 Supply air fan
56 Condensate drain
58 Sanitary Sewer
60 Condensate drain tray
62 Supply air plenum

DETAILED DESCRIPTION—FIGS. 5, 6, 7—PREFERRED EMBODIMENT

The present invention is described with reference to the enclosed. The present invention is a Drain Trap Alarm. The purpose of the system is to registrar an alarm when the fluid level within drain trap drops below a predetermined level and activate an automatic prime valve providing fluid to the dry drain trap. The Drain Trap Alarm monitors drain trap functions at all times for safe operations, and is an improvement over the current drain trap used for HVAC equipment.

Referring to FIG. 6 the present invention shows a typical supply fan with drain trap 22 as shown comprises a return air plenum 42, outside air plenum 38, supply air 62. The return air and outside air travel thru air filter 46, preheat coil 48, cooling coil 50, and finally the supply air 62 enters the occupied space. The cooling coil 50 develops condensation and is collected in condensate drain tray 60 and is removed by the condensate drain 56. The Drain Trap Alarm is attached to this conduit.

In a most preferred embodiment of the invention is illustrated in FIG. 7 the control circuit comprises of a microprocessor 78 supplies the liquid level sensor 20 with a potential which in turn detect the presence or absence of a electrically conductive liquid. The liquid level sensor 20 provide an input signal and execute an drain trap alarm output or drain trap normal output.

The drain trap alarm output comprises

1) Microprocessor de-activating the control panel normal indicator 66

2) Microprocessor activating an control panel alarm indicator 68

3) Microprocessor de-activating the remote normal 76

4) Microprocessor activating an remote alarm 74 comprising of a output signal that communicating a alarm condition to any remote device.

5) Microprocessor activating an automatic prime valve 30

The drain trap normal output comprises

1) Microprocessor de-activating the control panel alarm indicator 68

2) Microprocessor de-activating remote alarm 74

3) Microprocessor de energizing automatic prime valve 30

4) Microprocessor activating control panel normal indicator 66

5) Microprocessor activating an remote normal 76+comprising of output signal communicating a normal condition to any remote device.

The preferred Drain Trap Alarm is illustrated in FIG. 5 the drain trap 22 can be composed of multiple material such as cast bronze, poly vinyl chloride (PVC), copper. The preferred connections for drain trap 22 to the condensate drain conduit are the slip joint nut and seal 24(*a*) at condensate—In conduit and the slip joint nut and seal 24(*b*) and a ground joint elbow with female thread 26 connecting to the condensate—Out conduit 34. The slip joint nut and seal connections provide easy installation however drain trap 22 design installation connections can vary from threaded, soldered, flanged, glued or other similar connecting application.

The liquid level sensor 20 is illustrated in FIG. 5 comprises of a stainless steel probe 14 sheathed in a fused insulator 16 And sensor body 18 so as to sense a presence of a electrically conductance liquid between probe end 14 and sensor body 18 completing the circuit which in turn changes the condition of the liquid level sensor input 82. The liquid level sensor includes a delay circuit that controls a delay period between a time that a liquid is initially sensed by liquid level sensor and a time when said output signal is generated. The liquid level sensor is provided with ¼ inch male NPT for connection to the drain trap.

The drain trap FIG. 5 has three internal threaded ports.

1) The liquid level sensor port 12(*b*) comprises of a ¼ inch NPT. Internal thread with liquid level sensor connected to this port 2) The automatic prime valve port 12(*c*) comprises of a ¼ inch NPT. internal thread with a fixed air gap fitting 28 outlet is connected to this port as is well known that a air gap is required to prevent cross-connection with domestic water conduit 32

3) The drain trap test port 12(*a*) comprises of a ¼ inch NPT. Internal thread port with the inlet of drain trap test valve attached to port and outlet open to the external atmosphere.

Operation FIGS. 6,7,13

The microprocessor flow chart is shown at FIG. 13 and the Drain Trap Alarm is shown in FIG. 6 with liquid level sensor 20 continuously monitoring drain trap operation and communicating to the microprocessor indicating if drain trap is operating normal or drain trap is dry and in alarm. The liquid level sensor 20 in communications with the microprocessor will activate an alarm condition when the drain trap is dry. The microprocessor 78 in FIG. 7 will perform the following when liquid level sensor input 82 signals a alarm condition.

1) Microprocessor de-activating the control panel normal indicator 66

2) Microprocessor activating an control panel alarm indicator 68

3) Microprocessor de-activating the remote normal 76

4) Microprocessor activating an remote alarm 74 comprising of a output signal that communicating a alarm condition to any remote device.

5) Microprocessor energizing an automatic prime valve 30 to supply fluid when the fluid level within drain trap drops below a predetermined level. The liquid level sensor includes a delay circuit that controls a delay period between a time that a liquid is initially sensed by liquid level sensor and a time when said output signal is generated. The microprocessor will perform the following when liquid level sensor input 82 signals a normal condition:

1) Microprocessor de-activating the control panel alarm 68

2) Microprocessor de-activating remote alarm 74

3) Microprocessor de energizing automatic prime valve 30

4) Microprocessor activating control panel normal indicator 66

5) Microprocessor activating an remote normal 76 comprising of output signal communicating a normal condition to any remote device.

The Drain Trap Alarm is a critical device in maintaining proper indoor air quality and is provided with a convenient means of quickly testing such a device. The Drain Trap Alarm operational test comprises of a momentary switch that activates microprocessor output that energizes drain trap test valve 10 and when the fluid level within drain trap drops below a predetermined level the drain trap will be in alarm condition and perform the following:

1) Microprocessor de-activating the control panel normal indicator 66

2) Microprocessor activating an control panel alarm indicator 68

3) Microprocessor de-activating the remote normal 76

4) Microprocessor activating an remote alarm 74 comprising of a output signal that communicating a alarm condition to any remote device.

5) Microprocessor energizing an automatic prime valve 30 to supply fluid when the fluid level within drain trap drops below a predetermined level. The Drain Trap Test can be accomplished in less than 5 minutes.

FIGS. 8, 9, 10—Alternative Embodiments

The present alternative embodiments is described with reference to the enclosed. The present alternative embodiments invention is a Drain Trap Alarm. The purpose of the system is to registrar an alarm when the fluid level within drain trap drops below a predetermined level. The Drain Trap Alarm monitors drain trap functions at all times for safe operations, and is an improvement over the current drain trap used for HVAC equipment.

Referring to FIG. 10 the present invention shows a typical supply fan with drain trap 22 as shown comprises a return air plenum 42, outside air plenum 38, supply air 62. The return air and outside air travel thru air filter 46, preheat coil 48, cooling coil 50, and finally the supply air 62 enters the occupied space. The cooling coil 50 develops condensation and is collected in condensate drain tray 60 and is removed by the condensate drain 56. The Drain Trap Alarm is attached to this conduit. In a most alternative embodiment of the invention is illustrated in FIG. 9 the control circuit comprises of a microprocessor 78 supplies the liquid level sensor 20 with a potential which in turn detect the presence or absence of a electrically conductive liquid. The liquid level sensor 20 provide an input signal and execute an drain trap alarm output or drain trap normal output.

The drain trap alarm output comprises

1) Microprocessor de-activating the control panel normal indicator 66

2) Microprocessor activating an control panel alarm indicator 68

3) Microprocessor de-activating the remote normal 76

4) Microprocessor activating an remote alarm 74 comprising of a output signal that communicating a alarm condition to any remote device.

The drain trap normal output comprises

1) Microprocessor de-activating the control panel alarm 68

2) Microprocessor de-activating remote alarm 74

3) Microprocessor activating control panel normal indicator 66

4) Microprocessor activating an remote normal 76+comprising of output signal communicating a normal condition to any remote device.

The alternative Drain Trap Alarm is illustrated in FIG. 8 the drain trap 22 can be composed of multiple material such as cast bronze, poly vinyl chloride (PVC), copper. The preferred connections for drain trap 22 to the condensate drain conduit are the slip joint nut and seal 24(*a*) at condensate—In conduit and the slip joint nut and seal 24(*b*) and a ground joint elbow with female thread 26 connecting to the condensate—Out conduit 34. The slip joint nut and seal connections provide easy installation however drain trap 22 design installation connections can vary from threaded, soldered, flanged, glued or other similar connecting application.

The liquid level sensor 20 is illustrated in FIG. 8 comprises of a stainless steel probe 14 sheathed in a fused insulator 16 And sensor body 18 so as to sense a presence of a electrically conductance liquid between probe end 14 and sensor body 18 completing the circuit which in turn changes the condition of the liquid level sensor input 82. The liquid level sensor includes a delay circuit that controls a delay period between a time that a liquid is initially sensed by liquid level sensor and a time when said output signal is generated. The liquid level sensor is provided with 1 inch male NPT for connection to the drain trap.

The drain trap FIG. 5 has three internal threaded ports.

1) The internal threaded port 12(*b*) comprising of ¼ inch NPT. with liquid level sensor connected to this port 2) The internal threaded port 12(*c*) comprising of a ¼ inch NPT. with ¼ inch threaded plug 84(*a*) to manually prime drain trap with fluid.

3) The internal threaded port 12(*c*) comprising of a ¼ inch NPT. with inch threaded plug 84(*b*) provided for routine service to drain trap.

Operation FIGS. 8,9,14

The alternative embodiment of the invention provide a Drain Trap Alarm without the Drain Trap Alarm operational test. This alternative embodiment provide options that design conditions might require but still provide the three basic requirements of the Drain Trap Alarm 1-Monitoring drain trap function at all times.

2-Notify personnel of dry drain trap condition.

3-Providing an access port so fluid can be supplied to dry drain trap.

The microprocessor flowchart is shown at FIG. 14 and the Drain Trap Alarm is shown in FIG. 10 liquid level sensor 20 continuously monitoring drain trap operation and communicating to the microprocessor indicating if drain trap is operating normal or drain trap is dry and in alarm. The liquid level sensor 20 in communications with the microprocessor will activate an alarm condition when the drain trap is dry. The microprocessor 78 FIG. 9 will perform the following when liquid level sensor input 82 signals a alarm condition.

1) Microprocessor de-activating the control panel normal indicator 66

2) Microprocessor activating an control panel alarm indicator 68

3) Microprocessor de-activating the remote normal 76

4) Microprocessor activating an remote alarm 74 comprising of a output signal that communicating a alarm condition to any remote device.

The microprocessor will perform the following when liquid level sensor input 82 signals a normal condition.

1) Microprocessor de-activating the control panel alarm 68

2) Microprocessor de-activating remote alarm 74

3) Microprocessor activating control panel normal indicator 66

4) Microprocessor activating an remote normal 76 comprising of output signal communicating a normal condition to any remote device.

CONCLUSION, RAMIFICATION AND SCOPE

Accordingly the reader will see that the Drain Trap Alarm of the invention provides a highly reliable operating device that can continuously monitor drain trap operation and process this information and immediately notify operating personnel that drain trap is malfunctioning. This rapid notification of the drain trap malfunction provides the assurance to the people occupying space that personnel responsible for operating HVAC equipment will be notified of drain trap malfunction. The drain trap design is an remarkable device that only requirement for separating the contaminated air, unfiltered air, unconditioned air from being drawn into supply air system is WATER. This drain trap operation theory works when water is readily available, however water for a Air Handling Unit condensate drain trap is only available during air conditioning season and combining a lack of water with evaporation of water results in dry drain trap condition The AHU design is to supply uncontaminated air filtered air, and conditioned air to the occupied space that the fan supplies, however when condensate drain trap becomes dry these design characteristics of the AHU change. Now the AHU is supplying contaminated, unfiltered, and unconditioned air to the occupied space. The Drain Trap Alarm has the design capability of monitoring, notifying, and reacting to condensate drain malfunctions.

Furthermore, the Drain Trap Alarm has the additional advantages in that the microprocessor provides operational test switch enabling the HVAC operating personnel to quickly test Drain Trap Alarm.

I claim:

1. A drain trap alarm for heating ventilation air conditioning system comprising:

a drain trap collecting condensation with an upstream port coupled to air conditioning cooling coil drain tray and a downstream port open to the surrounding atmosphere, a liquid level sensor situated within said drain trap for communicating a input signal to a microprocessor, when fluid level within drain trap drops below a predetermined level results in alarm condition; wherein alarm means liquid level sensor communicating to the microprocessor for activating an alarm signal at the time of an alarm condition.

2. A drain trap alarm of claim 1 further comprising a automatic prime valve outlet connected to an internal port of said drain trap.

3. A drain trap alarm of claim 1 further comprising a drain trap test valve connected to an internal threaded port of said drain trap.

4. A drain trap alarm of claim 2 wherein an automatic prime valve inlet connects to domestic water supply.

5. A drain trap alarm of claim 1 wherein an automatic prime valve is energized during alarm condition.

6. A drain trap alarm of claim 1 further comprising of a remote alarm condition.

7. A drain trap alarm of claim 1 further comprising of a alarm indicator.

8. A drain trap alarm of claim 1 wherein said liquid level sensor includes a delay circuit that controls a delay period between a time that liquid is initially sensed by liquid level sensor and a time when an output is generated.

9. A drain trap alarm for heating ventilation air conditioning system comprising:

a drain trap collecting condensation with an upstream port coupled to air conditioning cooling coil drain tray and a downstream port open to the surrounding atmosphere, a liquid level sensor situated within said drain trap for communicating a input signal to a microprocessor, when fluid level within drain trap drops below a predetermined level results in normal condition; wherein normal means liquid level sensor is communicating to the microprocessor for activating a normal signal at time of an normal condition.

10. A drain trap alarm of claim 9 wherein said microprocessor de energizes an automatic prime.

11. A drain trap alarm of claim 9 wherein said microprocessor de energizes said remote alarm.

12. A drain trap alarm of claim 9 wherein said microprocessor de energize said alarm indicator.

13. A drain trap alarm of claim 9 comprises of a normal remote condition.

14. A drain trap alarm of claim 13 wherein said microprocessor energizes normal remote.

15. A drain trap alarm of claim 9 comprises of normal indicator.

16. A drain trap alarm of claim 15 wherein said microprocessor energizes said normal indicator.

17. A drain trap alarm of claim 9 comprising a drain trap operational test.

18. A drain trap alarm of claim 17 wherein drain trap test momentary switch is depressed said microprocessor energizes drain trap test valve to open and resulting in draining the said drain trap of fluid and triggering the drain trap into alarm condition.

* * * * *